US009475207B2

(12) United States Patent
Webber

(10) Patent No.: US 9,475,207 B2
(45) Date of Patent: Oct. 25, 2016

(54) WOOD CUTTING TOOL FOR CUTS ON A CURVED PROFILE

(71) Applicant: Flute Master LLC, Oklahoma City, OK (US)

(72) Inventor: Richard Melrose Webber, Oklahoma, OK (US)

( * ) Notice: Subject to any disclaimer, the term of this patent is extended or adjusted under 35 U.S.C. 154(b) by 819 days.

(21) Appl. No.: 13/906,323

(22) Filed: May 30, 2013

(65) Prior Publication Data

US 2014/0041759 A1 Feb. 13, 2014

Related U.S. Application Data

(60) Provisional application No. 61/689,405, filed on Jun. 5, 2012.

(51) Int. Cl.
*B27C 5/00* (2006.01)
*B27C 7/00* (2006.01)
*B27C 7/06* (2006.01)

(52) U.S. Cl.
CPC ..... *B27C 5/00* (2013.01); *B27C 7/005* (2013.01); *B27C 7/06* (2013.01)

(58) Field of Classification Search
CPC ..... B23C 7/00; B23C 7/02; B23B 25/00; B23B 25/065; B27C 3/00; B27C 3/02; B27C 3/04; B27C 3/06; B27C 3/08; B27C 5/003; B27C 5/00; B27C 5/08; B27C 5/02; B27C 7/005; B27C 7/06; B27C 7/00; B25B 1/00; B25B 5/00; B23Q 3/00; B23Q 3/005; B23Q 3/02; B23Q 9/0014; B23Q 9/0028; B23Q 9/0042; B23Q 9/0064; B23Q 9/02
USPC ..... 269/71, 53, 58, 87.3
See application file for complete search history.

(56) References Cited

U.S. PATENT DOCUMENTS

| | | | | |
|---|---|---|---|---|
| 3,277,933 | A * | 10/1966 | Lalli | B27C 7/06 142/38 |
| 3,362,447 | A * | 1/1968 | Elder, Jr. | B23Q 9/0014 408/109 |
| 4,627,773 | A * | 12/1986 | Ehnert | B23C 7/00 408/137 |
| 4,913,206 | A | 4/1990 | Altinbasak | |
| 6,539,992 | B1 * | 4/2003 | Nuss | B25H 1/0021 144/135.2 |
| 6,799,615 | B2 | 10/2004 | Smith | |
| 8,359,956 | B1 * | 1/2013 | Sutter | B23B 5/36 82/15 |
| 2010/0139808 | A1 * | 6/2010 | Thompson | B27C 7/06 142/49 |

* cited by examiner

*Primary Examiner* — Matthew G Katcoff
(74) *Attorney, Agent, or Firm* — Sean O'Connell, PLLC

(57) ABSTRACT

A wood working tool for cutting flutes on a curved profile, used with a wood lathe. The wood working tool includes a vertical mast secured to a base. A cutting tool holder is attached to the mast and can be connected at different positions to adjust the usable height to accommodate different size lathes. The tool holder supports a cutting tool such as router. The tool holder also supports a depth control bar with a roller at a working end of the control bar. The control bar is positioned such that the roller is near a cutter of the cutting tool. The depth control bar can be adjusted to allow for the cutting tool to cut a surface at a variety of depths. Moving the wood working tool along the length of the turning with the depth control bar engaged allows for cutting of the flute.

15 Claims, 2 Drawing Sheets

WOOD CUTTING TOOL FOR CUTS ON A CURVED PROFILE

CROSS REFERENCE TO RELATED APPLICATIONS

This application claims the benefit of U.S. Provisional Application No. 61/689,405 filed Jun. 5, 2012, the contents of which are incorporated fully herein by reference.

FIELD OF THE INVENTION

The present invention relates to wood cutting tools and more particularly to tools for cutting flutes on a curved profile.

BACKGROUND OF THE INVENTION

In wood working, cutting flutes or routed on a straight line, such as on a column, is relatively straight-forward and may be done with a router, die cut grinder, or other such tool. However, cutting flutes on a curved profile or surface proves more difficult and generally is performed by hand. There is not a tool that allows for use of a router or other power tool to cut flutes on a curved surface.

SUMMARY OF THE INVENTION

The present invention is directed to a wood working tool. The wood working tool comprises a base, a vertical mast secured to the base, a tool holder adjustably secured to the mast, a cutting tool supported by the tool holder, and a depth control bar supported by the tool holder. The tool holder of defines a through bore perpendicular to the mast and a depth control slot parallel to the through bore. The cutting tool is positioned within the through bore such that a cutting implement of the cutting tool extends from the tool holder. The control bar is positioned in the depth control slot such that a working end of the control bar is positioned proximate the cutting implement. A first plurality of set screws are adapted to secure the cutting tool in the tool holder, and a second plurality of set screws are adapted to secure the depth control bar to the tool holder.

In an alternative embodiment the present invention is directed to a wood working tool. The tool comprises a base, a vertical mast secured to the base, a tool holder adjustably secured to the mast, a cutting tool supported by the tool holder, the cutting tool comprising a cutting implement, and a depth control bar supported by the tool holder. A working end of the depth control bar is positioned proximate the cutting implement.

In yet another embodiment, the present invention is directed to a wood working tool. The wood working tool comprises a base, a vertical mast secured to the base, a tool holder adjustably secured to the mast, and a depth control bar supported by the tool holder. A working end of the depth control bar is positioned a. desired distance from the tool holder.

DETAILED DESCRIPTION OF THE INVENTION

Figure 1:
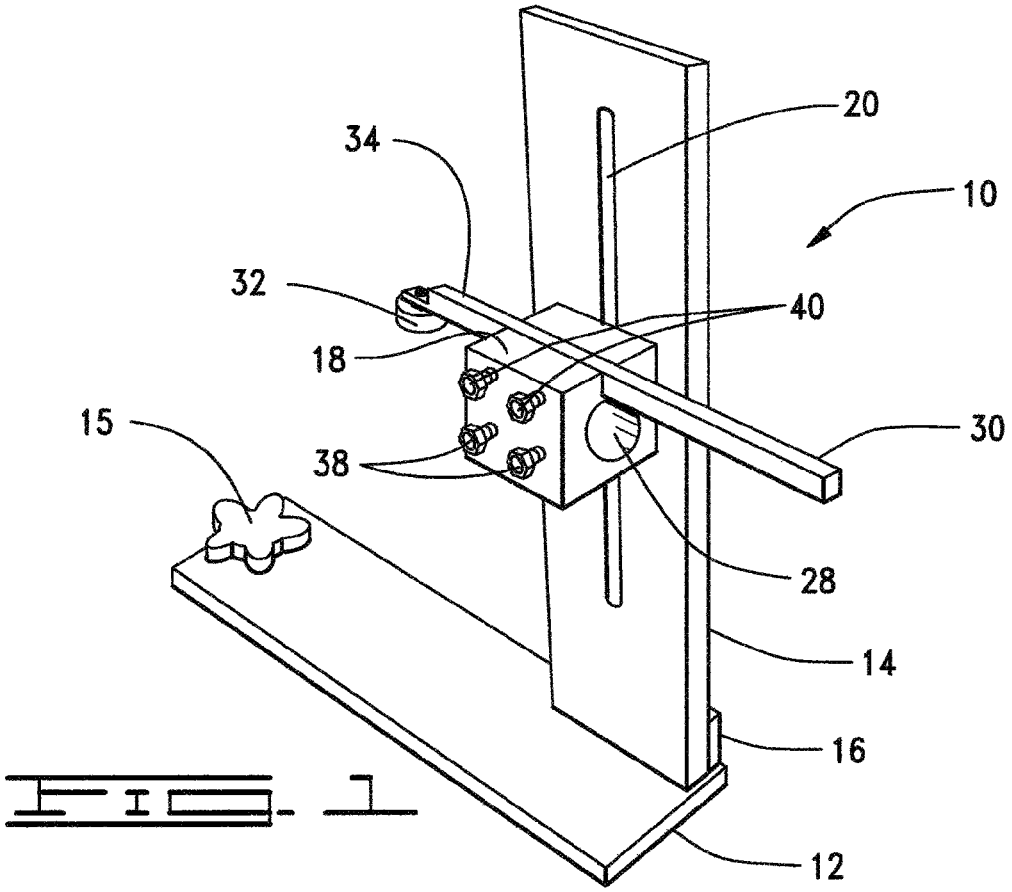
FIG. 1 is a perspective view of a wood working tool constructed in accordance with the present invention.

With reference now to the drawings in general and to FIG. 1 in particular, there is shown therein a preferred embodiment for a wood working tool constructed in accordance with the present invention. The wood working tool, designated by reference number 10, comprises a base 12 and a vertical mast 14 secured to the base. In the preferred embodiment, the mast 14 is secured to the base 12 using a brace 16. Connections between the base 12, the mast 14, and the brace 16 are preferably made with screws though any known manner may be used. Preferably, screws or other fasteners are recessed to allow for smooth surfaces. As shown in the FIG. 1, the wood working tool 10 also comprises a handle or knob 15 secured to the base 12 for gripping the tool during use.

Figure 2:
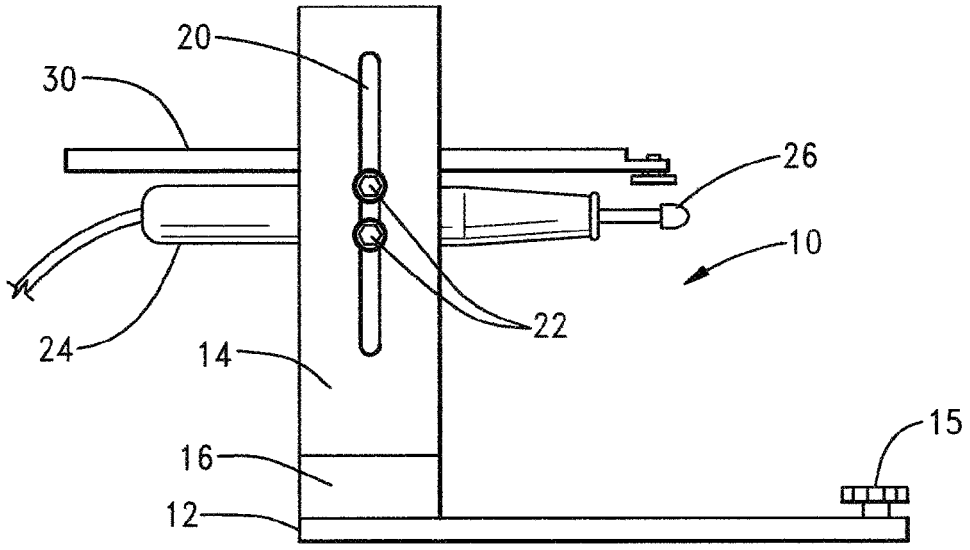
FIG. 2 is a back side elevation of the wood working tool shown in FIG. 1.

Continuing with FIG. 1 and with reference to FIG. 2, the wood working tool 10 further comprises a tool holder 18 adjustably connected to the mast 14. In the preferred embodiment, the mast 14 defines a vertical slot 20 to allow for the tool holder 18 to be positioned at a desired height on the mast. More preferably, the tool holder 18 is secured to the mast 14 with a plurality of height adjustment screws 22. The set screws 22 secure to the tool holder 18 through the vertical slot 20, as illustrated in FIG. 2. The tool holder 18 is adapted to support a cutting tool 24 (shown in FIG. 2) having a cutting implement 26. The cutting tool 24 may preferably be a router, a die cut grinder, or like tool. In a preferred embodiment, a Foredom or Wecheer drill, or pneumatic die grinder are used effectively as the cutting tool 24 with the present invention. Preferably, the tool holder 18 will comprise a block defining a through bore 28 perpendicular to the mast 14. The through bore 28 is preferably sized to accommodate the cutting tool 24.

The wood working tool 10 of the present invention further comprises a depth control bar 30 secured to the tool holder 18. The depth control bar 30 includes a roller 32 rotatably secured to a working end 34 of the control bar. As shown in FIG. 2, the depth control bar 30 is preferably secured to the tool holder 18 parallel to the cutting tool 24. More preferably, the control bar 30 is positioned such that the working end 34 and the roller 32 are proximate the cutting implement 26.

Figure 3:
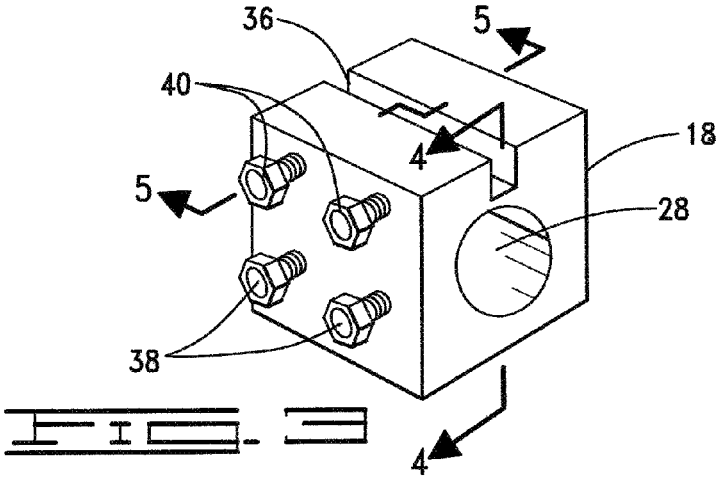
FIG. 3 is a perspective view of a tool holder for use with the wood working tool of FIG. 1.
Figure 4:
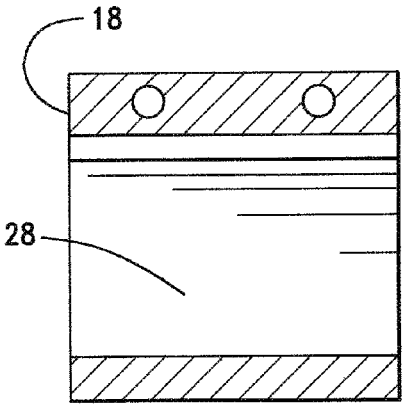
FIG. 4 shows a section view of the tool holder shown in FIG. 3 taken along cut line 4-4.
Figure 5:
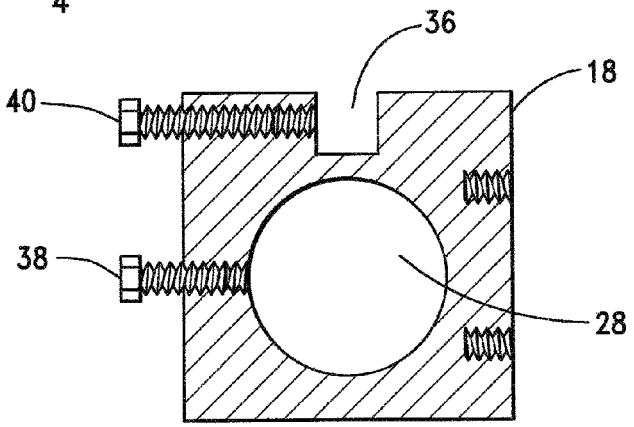
FIG. 5 shows a section view of the tool holder shown in FIG. 3 taken along cut line 5-5.

Referring now to FIGS. 3-5, the tool holder 18 is shown in greater detail. As shown therein, the tool holder 13 defines a depth control slot 36 parallel to the through bore 28. The depth control slot 36 is preferably sized to retain the depth control bar 30 substantially parallel to the through bore 28 and, consequently, the cutting tool 24. The depth control bar 30 is preferably capable of being slid in the slot 36 to allow the working end 34 of the control bar to be set at a desired distance from the tool holder 18. More preferably, the depth control bar 30 is positioned such that the working end 34 and roller 32 are at the desired position proximate the cutting implement 26 (discussed above). The tool holder 18 further comprises a first plurality of set screws 38 and a second plurality of set screws 40. The first plurality of set screws 38 is preferably used to secure the cutting tool 24 in the tool holder 18. The second plurality of set screws 40 is preferably used to secure the depth control bar 30 in the depth control slot 36. Alternatively, one skilled in the art will appreciate other fasteners or clamps may be used to secure the cutting tool 24 and the depth control bar 30 to the tool holder 18. Additionally, shims, washers, or other implements may be used if the cutting tool 24 is smaller than the through bore 28 in the tool holder 18.

Figure 6:
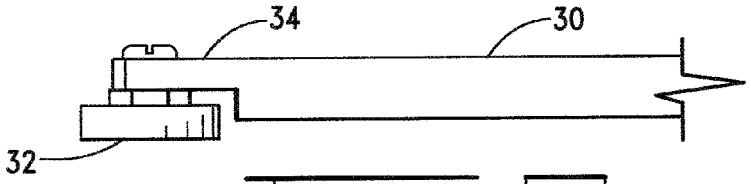
FIG. 6 is a partial view of a depth control bar for use with the wood working tool shown in FIG. 1.
Figure 7:
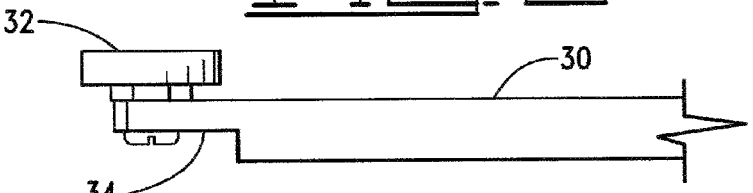
FIG. 7 is an alternative embodiment for the depth control bar shown in FIG. 6.

Turning now to FIG. 6 the depth control bar 30 is shown in greater detail. As illustrated therein, the depth control bar 30 is shown with the roller 32 rotatably secured to the working end 34 of the depth control bar. The attachment of the roller 32 to the control bar 30 as shown allows for the roller to be positioned proximate the cutting implement 26, to allow for the cutting implement to cut at the desired depth. Referring to FIG. 7, an alternative embodiment for the configuration of the roller 32 on the working end 34 of the depth control bar 30 is shown. The alternative embodiment shown in FIG. 7 allows for additional separation of the roller 32 from the cutting implement 26. One skilled in the art will appreciate the usefulness of the alternative embodiment depending on the curvature of the profile.

Operation and use of the wood working tool 10 allows for flutes of consistent depth and length to be made on a turning in a wood lathe or like machine, regardless of the profile of the turning. The wood working tool is preferably used to cut a turning secured in the lathe. With the mast 14 secured to the base 12, the base is placed on the bed of the lathe. The cutting tool 24, having the preferred cutting implement 26, is placed in the tool holder 18 and secured with the first plurality of set screws 38. The tool holder 18 is then secured to the mast 14 at the desired height to allow the cutting implement 26 to be at the same height as the center of the lathe head stock. The depth control bar 30 is then secured to the tool holder 18 with the second plurality of set screws 40. The depth control bar 18 can be positioned relative to the cutting implement 26 to allow for flutes of the desired depth. With the wood working tool 10 held at the desired start of the flute, the cutting implement 26 is pressed firmly into the turning. Holding the cutting implement 26 against the turning, the tool 10 is moved from right to left until it stops at the desired end of the flute. As the cut is being made, the tool 10 may be rotated so the cutting tool 24 is at right angles to the turning. Blocks or stops secured to the lathe bed may be used to indicate start and stop points for the cuts.

The wood working tool 10 may also be used effectively to make cuts with a turning lathe. To cut inlays and router profiles, the tool 10 can be held in place on the lathe bed. Additionally, the roller 32 of the depth control bar 30 can be turned 90 degrees to allow the roller to roll vertically on the turning surface, and set to allow for the desired cut depth. Running the lathe will allow consistent inlays or router profiles to be made Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that the invention may be practiced otherwise than as specifically illustrated, and described.

What is claimed is:

1. A wood working tool comprising:

a base;

a vertical mast secured to the base;

a tool holder adjustably secured to the mast;

wherein the tool holder defines a through bore perpendicular to the mast; and wherein the tool holder defines a depth control slot parallel to the through bore;

a cutting tool supported by the tool holder, the cutting tool positioned within the through bore such that a cutting implement of the cutting tool extends from the tool holder;

a depth control bar supported by the tool holder, the control bar positioned in the depth control slot such that a working end of the control bar is proximate the cutting implement;

a first plurality of set screws, the set screws adapted to secure the cutting tool in the tool holder; and a second plurality of set screws, the set screws adapted to secure the depth control bar to the tool holder.

2. The wood working tool of claim 1 further comprising a plurality of height adjustment screws, the screws adapted to secure the tool holder to the mast;

wherein the mast defines a vertical slot; and wherein the tool holder is positioned at a desired location along the mast and secured to the mast by securing the height adjustment screws through the vertical slot.

3. A wood working tool comprising:

a base;

a vertical mast secured to the base;

a tool holder adjustably secured to the mast;

a cutting tool supported by the tool holder, the cutting tool comprising a cutting implement; and a depth control bar supported by the tool holder;

wherein a working end of the depth control bar is positioned proximate the cutting implement;

the tool holder comprises a block, the block defining a through bore perpendicular to the mast; and wherein the cutting tool is supported in the through bore; and wherein the tool holder further defines a depth control slot parallel to the through bore, the depth control bar being supporteed in the depth control slot.

4. The wood working tool of claim 3 further comprising:

a first plurality of set screws, the set screws adapted to secure the cutting tool in the tool holder; and a second plurality of set screws, the set screws adapted to secure the depth control bar to the tool holder.

5. The wood working tool of claim 4 wherein the cutting tool is positioned within the through bore such that a cutting implement of the cutting tool extends from the tool holder; and wherein the control bar is positioned in the depth control slot such that a working end of the control bar is proximate the cutting implement.

6. The wood working tool of claim 3 wherein the depth control bar comprises a roller rotatably secured to a working end of the depth control bar.

7. The wood working tool of claim 3 wherein the cutting tool comprises a router and wherein the cutting implement comprises a router bit.

8. The wood working tool of claim 3 wherein the tool holder comprises a clamp.

9. A wood working tool comprising:

a base;

a vertical mast secured to the base;

a tool holder adjustably secured to the mast;

a depth control bar supported by the tool holder;

wherein a working end of the depth control bar is adjustably positioned a desired distance from the tool holder;

a cutting tool supported by the tool holder, the cutting tool comprising a cutting implement having a cutting end;

the working end of the depth control bar is positioned adjacent the cutting end of the cutting implement.

10. The wood working tool of claim 9 wherein the tool holder comprises a block, the block defining a through bore perpendicular to the mast; and wherein the cutting tool is supported in the through bore; and wherein the tool holder further defines a depth control slot parallel to the through bore, the depth control bar being supported in the depth control slot.

11. The wood working tool of claim 10 further comprising:

a first plurality of set screws, the set screws adapted to secure the cutting tool in the tool holder; and a second plurality of set screws, the set screws adapted to secure the depth control bar to the tool holder.

12. The wood working tool of claim 11 wherein the cutting tool is positioned within the through bore such that a cutting implement of the cutting tool extends from the tool holder; and wherein the control bar is positioned in the depth control slot such that a working end of the control bar is proximate the cutting implement.

13. The wood working tool of claim 9 wherein the depth control bar comprises a roller rotatably secured to a working end of the depth control bar.

14. The wood working tool of claim 9 wherein the cutting tool comprises a router and wherein the cutting implement comprises a router bit.

15. The wood working tool of claim 9 wherein the tool holder comprises a clamp.

* * * * *